US008992732B2

(12) United States Patent
Lindström et al.

(10) Patent No.: US 8,992,732 B2
(45) Date of Patent: Mar. 31, 2015

(54) SYSTEM AND PROCESS FOR IMPROVING PAPER AND PAPER BOARD

(71) Applicant: Innventia AB, Stockholm (SE)

(72) Inventors: Tom Lindström, Sollentuna (SE); Anna Svedberg, Bollstabruk (SE); Mikael Ankerfors, Upplands Väsby (SE)

(73) Assignee: Innventia AB, Stockholm (SE)

( * ) Notice: Subject to any disclaimer, the term of this patent is extended or adjusted under 35 U.S.C. 154(b) by 0 days.

(21) Appl. No.: 14/365,589

(22) PCT Filed: Dec. 17, 2012

(86) PCT No.: PCT/SE2012/051417

§ 371 (c)(1),
(2) Date: Jun. 13, 2014

(87) PCT Pub. No.: WO2013/089638

PCT Pub. Date: Jun. 20, 2013

(65) Prior Publication Data

US 2014/0345817 A1 Nov. 27, 2014

Related U.S. Application Data

(60) Provisional application No. 61/576,250, filed on Dec. 15, 2011.

(30) Foreign Application Priority Data

Dec. 15, 2011 (SE) ..... 1151205

(51) Int. Cl.

| | |
|---|---|
| ***D21H 17/45*** | (2006.01) |
| ***D21H 17/00*** | (2006.01) |
| ***D21H 17/37*** | (2006.01) |
| ***D21H 17/06*** | (2006.01) |
| ***D21H 17/67*** | (2006.01) |
| ***D21H 17/68*** | (2006.01) |
| ***D21H 21/10*** | (2006.01) |
| *D21H 17/42* | (2006.01) |

(52) U.S. Cl.

CPC ..... *D21H 17/74* (2013.01); *D21H 17/375* (2013.01); *D21H 17/06* (2013.01); *D21H 17/37* (2013.01); *D21H 17/42* (2013.01); *D21H 17/45* (2013.01); *D21H 17/67* (2013.01); *D21H 17/68* (2013.01); *D21H 21/10* (2013.01)

USPC ..... 162/164.6

(58) Field of Classification Search

None

See application file for complete search history.

(56) References Cited

U.S. PATENT DOCUMENTS

| | | | | |
|---|---|---|---|---|
| 2007/0010386 | A1 * | 1/2007 | Champ et al. | 493/51 |
| 2007/0119560 | A1 * | 5/2007 | Birkert et al. | 162/158 |
| 2009/0065162 | A1 | 3/2009 | Cheng et al. | |

FOREIGN PATENT DOCUMENTS

| | | | |
|---|---|---|---|
| EP | 2 319 984 | B1 | 5/2011 |
| JP | 2003-119696 | A1 | 4/2003 |
| WO | WO 01/34908 | A1 | 5/2001 |
| WO | WO 2006/123989 | A2 | 11/2006 |

* cited by examiner

*Primary Examiner* — Mark Halpern

(74) *Attorney, Agent, or Firm* — Knobbe, Martens, Olson & Bear, LLP

(57) ABSTRACT

The invention relates to a process for making paper or paper board comprising forming a cellulosic suspension, flocculating the suspension, draining the suspension on a device to form a sheet and then drying the sheet, wherein the suspension is flocculated using a formation improving 3-component flocculation system comprising a) a linear cationic or amporteric co-polymer of: i) acrylamide, and ii) a substance with formula (I) with a halide as counter-ion; b) at least one water soluble component chosen from the group of anionic polyacrylamide, non-ionic polyacrylamide and polyethyleneoxide; and c) inorganic microparticles, whereby the flocculation system does not contain a wafer-dispersible or branched anionic organic polymer. The invention also relates to use of the flocculation/retention system in the manufacture of paper or paper board, and to paper and paper board thus produced.

21 Claims, 4 Drawing Sheets

Figure 1:
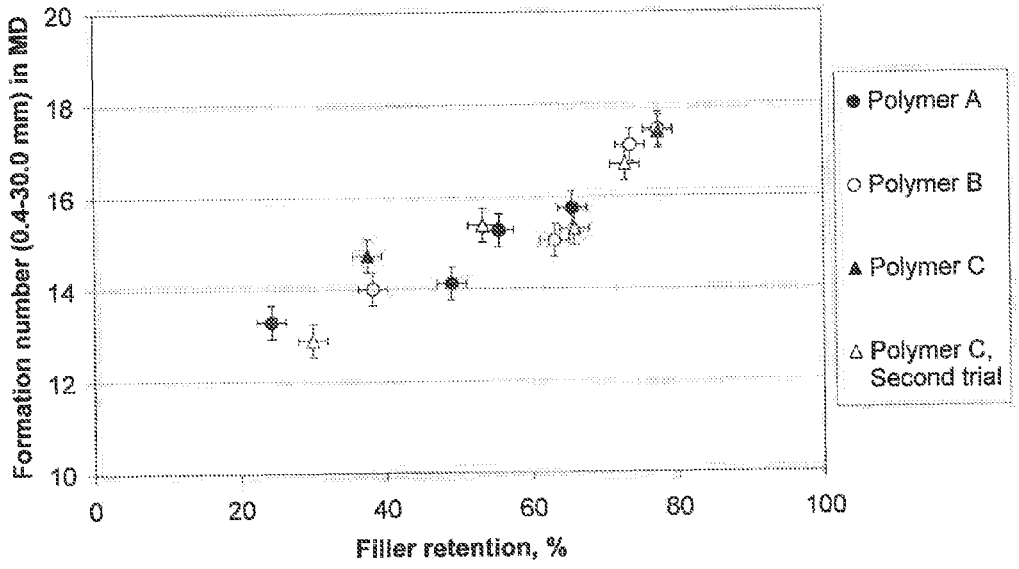

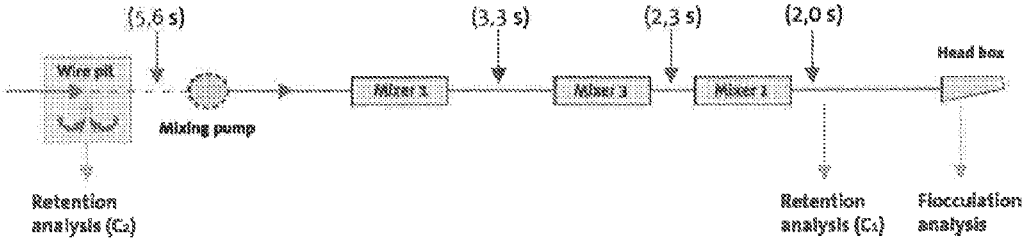
Fig 3. Dosage system.
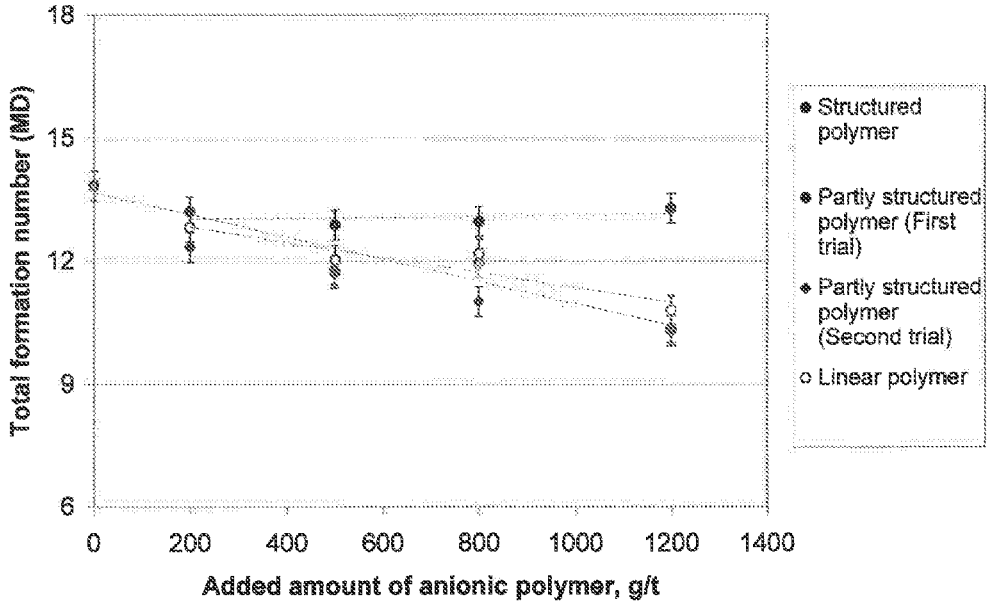
Fig 4.

SYSTEM AND PROCESS FOR IMPROVING PAPER AND PAPER BOARD

This application is a 371 of PCT/SE2012/051417 filed 17 Dec. 2012

FIELD OF INVENTION

The present invention relates to a process for making paper or paper board comprising forming a cellulosic fibre suspension, flocculating the suspension, draining the suspension on a device to form a sheet and then drying the sheet, characterised in that the suspension is flocculated using a formation improving 3-component flocculation system comprising a) a linear cationic or amphoteric co-polymer of i) acrylamide, and ii) a substance of formula I with a halide as counter-ion; b) at least one water soluble component chosen from the group of anionic, polyacrylamide, non-ionic polyacrylamide and polyethyleneoxide; and c) inorganic microparticles, whereby the flocculation system does not contain a water-dispersible or branched anionic organic polymer. Nanofibrillar Cellulose (NFC) may be added to the flocculation system.

The invention also relates to use of a flocculation/retention system in the manufacture of paper or paper board materials, and to paper and paper board thus produced.

PRIOR ART

During manufacturing of paper and paper board materials a stock of cellulosic fibres are drained on a machine wire. The wet web is transferred to a pressing section and then to the drying section, where the paper is dried and finally collected on the tambour as a roll of paper or paper board. Fillers (clays, ground or precipitated calcium carbonate, titanium dioxide etc.) are added as today's papermaking industry is focusing on reducing the consumption of raw material and energy. Modern paper machines operate at high speeds with extensive drainage in the wire section which requires the use of flocculants to retain the fines and fillers on the wire.

Two parameters, almost always critical to good paper making, are filler retention and paper formation. Formation, or paper uniformity, is one of the most important quality characteristics of paper materials, whereas high fines/filler retention is an important process parameter. The latter is important with respect to productivity and wet-end stability of the paper machine, and the z-directional uniformity of filler distribution. Filler retention is provided by using various types of retention aid systems, which are all characterized by being powerful flocculants. Flocculants deteriorate paper formation, and there is consequently a delicate balance between paper formation and retention, which is in this context referred to as the retention-formation relationship.

With today's developments within modern papermaking (e.g. higher degrees of white water system closure, higher machine speeds, increased filler content and twin wire forming) the wet-end chemistry has become more complex. This has resulted in increased demands on the performance of chemical adjuvants, including the retention aids (flocculants).

Retention aids are used in order to retain filler and fines in the papermaking process. Common for retention aids is that they cause fine and filler materials to aggregate to larger units, which are retained in the wet paper web during dewatering. High retention is advantageous in many aspects, e.g. higher machine efficiency, faster response to changes in process conditions, less circulating material and less material carry-over between paper machines with connected white water systems. It is well-known that retention aids, being powerful flocculants, deteriorate paper formation. The uniformity of paper formation also depends on fibre flocculation and shearing conditions in the forming section and the addition of other chemical adjuvants. Poor paper formation has negative impacts on various paper properties such as paper strength, opacity and printability. The challenge for today's papermakers is to achieve an acceptable level of filler retention, while maintaining or improving the paper formation.

There is a wealth of different retention aid systems introduced on the market today, which may be grouped by their chemical nature, aggregation mechanism or number of system components. The mechanism of action and development of retention aids have been well described in several reviews (see e.g. "Some Fundamental Chemical Aspects on Paper Forming" Lindström T "Fundamentals of papermaking" Vol 1 p 309 Ed by Baker C, F & Punton V W, Mech. Eng. Pub. Ltd. (London) 1989).

In the early 1980s, the first microparticulate systems were introduced and these systems are dominating the market today. Microparticle-based retention aids are normally based on combinations of cationic polymers and anionic inorganic colloids.

The first two commercial microparticle-based retention aids were based on cationic starch together with anionic colloidal silica and on cationic polyacrylamide together with anionic montmorillonite clay. After these precursors, the development of new microparticle-based retention aid systems have advanced. During the 1990s, several new microparticle-based retention aid systems were reported on, including new types of microparticles and modifications of existing systems.

Today, there are still ongoing developments in the area of retention/dewatering systems. More recently developed retention aid systems are usually multi-component systems. However, there is also a progress regarding new types of microparticles, e.g. so-called cross-linked microparticles, which may be composed of organic particles.

Most of today's commercial retention aids are able to achieve acceptable levels of filler retention, even in high-speed twin-wire formers. This is partly explained by their ability to produce shear-resistant flocs which can reflocculate after dispersion. This reflocculation takes place after dispersion of a suspension treated with a microparticulate retention aid. The primary benefit of microparticulate retention aids is their beneficial effect on dewatering. This benefit of microparticle systems has been demonstrated also in studies focusing on the reversibility of flocculation. However, the retention aid should not be allowed to create flocs with too high floc strength, since that would impair paper formation.

Only a few systematic studies are available that describe the balance between filler retention and paper formation and furthermore examine whether some retention aids are more detrimental to paper formation than others. However, a common denominator in the available studies is the difficulty of breaking the interdependence between retention and paper formation or fibre dispersions.

Recent studies have also confirmed that it is difficult to break the interdepence between retention and formation, both for classical retention aid systems and modern microparticulate systems. There are, however, claims in the patent literature which state that the use of branched/cross-linked polyelectrolytes in conjunction with microparticles should be beneficial to the retention/formation relationship (WO 9829604, CA 2425197). It has also been suggested that the three-component systems composed of a dual microparticulate system and an organic microparticle should be beneficial for the purpose (U.S. Pat. No. 6,524,439). However, this patent application does not mention cationic co-polymer of acrylamide and N,N,N-trimethylamino-ethylacrylate, N,N,N-trimethyl-2-aminoethyl methacrylamide or 3-acrylamide-3-methyl-butyl-trimethyl-ammonium chloride nor nanofibrillar cellulosic material.

Paper machine headboxes are often equipped with a "turbulence generator". A turbulence generator is basically a tube bank, where the stock is accelerated and fibre flocs are broken up. The basic function of the turbulence generator is to even out the cross directional (CD) mass distribution of fibres, giving an even CD mass distribution of fibres in the paper sheet. When the dispersed fibres leave the tube bank in the headbox, they start to flocculate in the decaying turbulence. This is explained by the fact that during dispersion, the fibres are exposed to viscous and dynamic forces that tend to bend the fibres. When the turbulence decays, the fibres tend to regain their original shape. If there are many fibres per unit volume they cannot straighten out freely. Instead, they will come to rest in a strained position and be interlocked by normal and friction forces constituting the fibre network (floc). The higher the turbulence, the stronger the reflocculation tends to be.

Another important observation is that addition of high molecular weight anionic polyacrylamide can dampen the turbulence and improve the formation of paper as a single component additive. The draw-back is that the dewatering is severely impaired, resulting in little practical utility of such a system (Lee, P. and Lindström, T. (1989) Nord. Pulp Paper Res. J., 4(2), p. 61-70). Systems with a higher complexity, such as those disclosed in this patent application, must be utilized in order to alleviate the negative effects of the impaired dewatering.

SUMMARY OF THE INVENTION

It has, astonishingly, been found that a flocculation system combining a) a linear cationic or amphoteric co-polymer of i) acrylamide, and ii) a substance of formula I in the form of a halide, with: b) at least one water-soluble component chosen from the group of anionic polyacrylamide, non-ionic polyacrylamide and polyethyleneoxide; and c) inorganic microparticles, whereby the composition does not contain a water-dispersible or branched anionic organic polymer, can significantly improve the formation of paper at a given retention level without sacrificing dewatering. Most importantly, it was found that, with such three-component systems, the impairment of drainage could be avoided and, hence, that the improved formation was not provided at the expense of drainage on the wire section.

Thus, the invention relates to the use of a flocculation system, and to a process for making paper or paper board comprising forming a cellulosic suspension, flocculating the suspension, draining the suspension on a device to form a sheet and then drying the sheet, characterised in that the suspension is flocculated by use of the flocculation system. The invention also relates to paper and paper board produced using the process and system.

Without being bound to any theory, the mechanism behind the flocculation system is believed to be related to the action of turbulence damping during paper formation.

By addition of NFC to the three-component flocculation system, a synergistic effect on turbulence damping and hence formation enhancement may be obtained, by the presence of fibres, soluble high-molecular weight polyelectrolyte and NFC. Addition of NFC also enhances the strength of the paper by improving bonding between the fibres and between other constituents in the stock.

DETAILED DESCRIPTION OF THE INVENTION

The invention relates to a process for making paper or paper board comprising forming a cellulosic suspension, flocculating the suspension, draining the suspension on a device to form a sheet and then drying the sheet, characterised in that the suspension is flocculated using a flocculation system comprising a) a linear cationic or amphoteric co-polymer of i) acrylamide, and ii) a substance with formula I

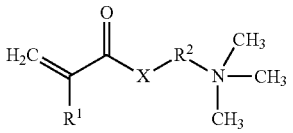

wherein $R^1$ is H or $CH_3$

X is O or NH $R^2$ is $C_1$-$C_4$ alkyl, which is substituted with a cationic methyl group with a halide as counter-ion, b) at least one water-soluble component chosen from the group of anionic polyacrylamide, non-ionic polyacrylamide and polyethyleneoxide; and c) inorganic microparticles, whereby the flocculation system does not contain a water-dispersible or branched anionic organic polymer.

According to one embodiment the flocculation system further comprises nanofibrillated cellulose (NFC; also commonly known as microfibrillated cellulose, MFC).

The suspension is a water suspension of pulp fibres. According to one embodiment, filler and/or pigments may be added. The suspension may be a suspension of pulp, especially fibrous pulp made from hardwood and/or softwood fibres. According to one embodiment, the pulp is a refined hardwood and/or softwood bleached kraft pulp. The cellulosic fibres, which can be used in the present invention, may be bleached, half-bleached or unbleached sulphite, sulphate (kraft) or soda pulps, bleached, half-bleached or unbleached (chemi)mechanical pulp, (chemi)thermomechanical pulp, as well as mixtures of these pulps in any mixing ratio. Both virgin pulps as well as dried and recycled fibres can be used in accordance with this invention, as well as fibre materials stemming from a wide array of plant fibres, softwood fibres and hardwood fibres. Hence, non-wood fibres such as cotton, kenaf, various grass species as well as regenerated cellulosic fibres can be used.

The pH-value of the pulp suspension may be 6-9, e.g. 8.0. $NaHCO_3$ may be added as a catalyst for sizing with alkyl ketene dimers.

Many cationic polymers are sensitive to hydrolysis and can easily become amphoteric and, hence, such linear polymers are included in the inventive concept. The cationic or amphoteric high-molecular weight polymer is suitably a cationic and/or amphoteric polyacrylamide, preferably a cationic acrylamide-based polymer. The polymer can have a cationicity ranging from 1 to 100 mole % (mole % cationic monomer in the polymer backbone), suitably from 1 to 80 mole % and preferably from 1 to 60 mole %. According to one embodiment the molecular weight is from above $2\times10^6$ Daltons, e.g. above $4\times10^6$, above $5\times10^6$, above $10\times10^6$, above $20\times10^6$, above $30\times10^6$, above $40\times10^6$, above $50\times10^6$, above $60\times10^6$, above $70\times10^6$, above $80\times10^6$ above $90\times10^6$. The molecular weight may also lie in any interval created from any of the above molecular weights e.g. from $2\times10^6$ Daltons to $20\times10^6$ Daltons, e.g. from $4\times10^6$ Daltons to $15\times10^6$ Daltons. The upper limit is not critical.

The cationic or amphoteric high molecular weight linear polymer may be a copolymer between acrylamide and a substance with formula I, with a halide as counter-ion. According to one embodiment the substance of formula I is chosen from N,N,N-trimethyl-2-aminoethyl acrylate, N,N,N-trimethyl-2-aminoethyl methacryl amide or 3-acrylamide-3-methyl-butyl-trimethyl-ammonium chloride.

The charge of the anionic polyacrylamide is not critical, but should be chosen to minimize the adsorption of the polymer to dispersed materials in the stock. According to one embodiment the molecular weight is from above $2\times10^6$ Daltons, e.g. above $4\times10^6$, above $5\times10^6$, above $10\times10^6$, above $20\times10^6$, above $30\times10^6$, above $40\times10^6$, above $50\times10^6$, above $60\times10^6$, above $70\times10^6$, above $80\times10^6$, or above $90\times10^6$. The molecular weight may also lie in any interval created from any of the above molecular weights, e.g. from $2\times10^6$ Daltons to $20\times10^6$ Daltons, e.g. from $4\times10^6$ Daltons to $15\times10^6$ Daltons. The upper limit is not critical.

The anionic polyacrylamide is linear. The non-ionic polyacrylamide may also be linear. The polyethyleneoxide may also be linear. According to the invention, it has turned out that linear anionic polyacrylamide, linear non-ionic polyacrylamide and linear polyethyleneoxide give better formation than cross-linked polymers. However, slightly cross-linked polymer may also give acceptable results. Therefore, according to the invention the non-ionic and polyacrylamide and the polyethyleneoxide, respectively, may comprise up to 1%, 2%, 3%, 4%, 5%, 6%, 7%, 8%, 9%, 10%, 11%, 12%, 13%, 14%, 15%, 16%, 17%, 18%, 19%, or 20% cross-linking counted on a fully cross linked polymer, or any interval created by any of the above mentioned percentages.

According to one embodiment the anionic polymer is a linear high-molar mass water-soluble polyacrylamide derivative, e.g. an anionic co-polymer such as Percol 156 from BASF.

Anionic polymers can be made by hydrolyzing polyacrylamide polymers etc., e.g. those made by polymerizing such monomers with (meth)acrylic acid and their salts, 2-acrylamido-2-methylpropane sulfonate, sulfoethyl-(meth)acrylate, vinylsulfonic acid, styrene sulfonic acid, maieic or other dibasic acids or their salts or mixtures thereof.

According to one embodiment, the anionic high molecular weight anionic and/or non-ionic polyacrylamide have an anionicity from 0 to 100 mole % anionic groups, suitably below 80 mole % and preferably from 0 to 60%.

The molecular weight of the polyacrylamide or polyethyleneoxide may be above $10^6$ Daltons. The upper limit is not critical. The higher the molecular weight, the more efficient the polymer is in damping the turbulence.

According to one embodiment the molecular weight is from above $2\times10^6$ Daltons, e.g. above $4\times10^6$, above $5\times10^6$, above $10\times10^6$, above $20\times10^6$, above $30\times10^6$, above $40\times10^6$, above $50\times10^6$, above $60\times10^6$, above $70\times10^6$, above $80\times10^6$, or above $90\times10^6$. The molecular weight may also lie in any interval created from any of the above molecular weights, e.g. from $2\times10^6$ Daltons to $20\times10^6$ Daltons, e.g. from $4\times10^6$ Daltons to $15\times10^6$ Daltons.

The addition level of the anionic and/or non-ionic polymer are in the range of 50-2000 g/tonne paper or paper board, preferably 100-1500 g/tonne paper or paper board.

The inorganic microparticles may be chosen from silica based particles, silica microgels, colloidal silica, silica sols, silica gels, polysilicates, cationic silica, aluminosilicates, polyaluminosilicates, borosilicates, polyborosilicates, zeolites, bentonite, hectorite, smectites, montmorillonites, nontronites, saponite, sauconite, hormites, attapulgites and sepiolites and other swellable clays. According to one embodiment the inorganic microparticles may be chosen from siliceous materials, e.g. from montmorillonite clay and colloidal silica such as anionic silica and Na montmorillonite (e.g. Hydrocol SH).

The nano-fibrillated cellulose (NFC), which may be added to the flocculation system, is a material composed of nano-sized cellulose fibrils with a high aspect ratio (length to width ratio). Typical dimensions are 5-20 nanometers width and a length up to 2000 nanometers. NFC exhibits the property of being thick (viscous) under normal conditions, but may flow (become thin, less viscous) over time when shaken, agitated, or otherwise being in a stressed state. The fibrils are isolated from any cellulose containing source including plants and wood-based fibres (pulp fibres), e.g. through high-pressure and high velocity impact homogenization. An energy-efficient production usually requires some kind of enzymatic/chemical/mechanical pre-treatment prior to homogenization. In addition to the dry-strength adjuvant effect of NFC in papermaking. NFC is in accordance with the invention used to dampen the turbulence in papermaking.

The nanofibrillar cellulose may be added in a quantity from 1 to 80 kg/tonne, preferably from 2 to 40 kg/tonne, counted on tonne paper or paper board.

The charge density of the anionic polyacrylamide used is not critical, but should be chosen to minimize the adsorption of the polymer to the dispersed materials in the stock.

According to the invention, the components of the flocculation system may be introduced separately.

The linear cationic or amphoteric high molecular weight polyelectrolyte is preferably introduced first into the system, whereupon the inorganic microparticles, the e.g., anionic polyacrylamide and NFC, as the case may be, are added. The order in which the latter chemical additives are added is not critical.

The cellulosic suspension may comprise a filler. The filler may constitute any of the generally used filler materials. For instance, the filler may constitute clay(s), such as kaolin, ground or precipitated calcium carbonate, talk or titanium dioxide. Exemplary filler materials also include synthetic polymeric fillers.

It has turned out that the flocculation system according to the invention, comprising a linear cationic or amphoteric co-polymer, an anionic polyacrylamide, and/or non-ionic polyacrylamide, and/or polyethyleneoxide, and inorganic microparticles, dampens the turbulence in papermaking and also improves the formation of the paper. This is especially so if the flocculation system also comprises NFC.

The invention also regards the use of a flocculation system comprising a) a linear cationic or amphoteric co-polymer of i) acrylamide, and ii) a substance with formula I in the form of a halide; b) an anionic and/or non-ionic polyacrylamide and/or polyethyleneoxide; and c) inorganic microparticles for improving retention, dewatering and formation in a process for making paper or paper board.

All details mentioned above regarding components and process features apply mutatis mutandis for the use of the flocculation system and the product of the process, i.e. the paper and paper board. This applies to exemplary molecular weights, linearity, ionicity, inorganic microparticles made use of and NFC characteristics.

All publications mentioned herein are hereby incorporated as reference, to the fullest extent permitted by law. The invention will now be described by the following non-limiting examples.

SHORT DESCRIPTION OF THE FIGURES

The invention is illustrated by the below Figures.

FIG. 1 shows the total formation number (0.4-30 mm) in the machine direction as a function of the filler retention (%), for three cationic polyacrylamides of varying molecular weights (Polymer A-C). The polymers used in the retention trial with the single component systems were three commercial cationic polyacrylamides: Polymer A (Mw=3-4×$10^6$ Daltons. Charge density=+0.82 meq/g); Polymer B (Mw=6-8×$10^6$ Daltons. Charge density=+1.02 meq/g); Polymer C (Mw=10-11×$10^6$ Daltons. Charge density=+1.06 meq/g). Polymer addition levels between 500-1500 g/ton. The study was performed on the R-F-machine for a fine paper stock (Hardwood/Softwood ratio 9/1) with addition of 20% Ground Calcium Carbonate (GCC) filler (based on solids content).

Figure 2:
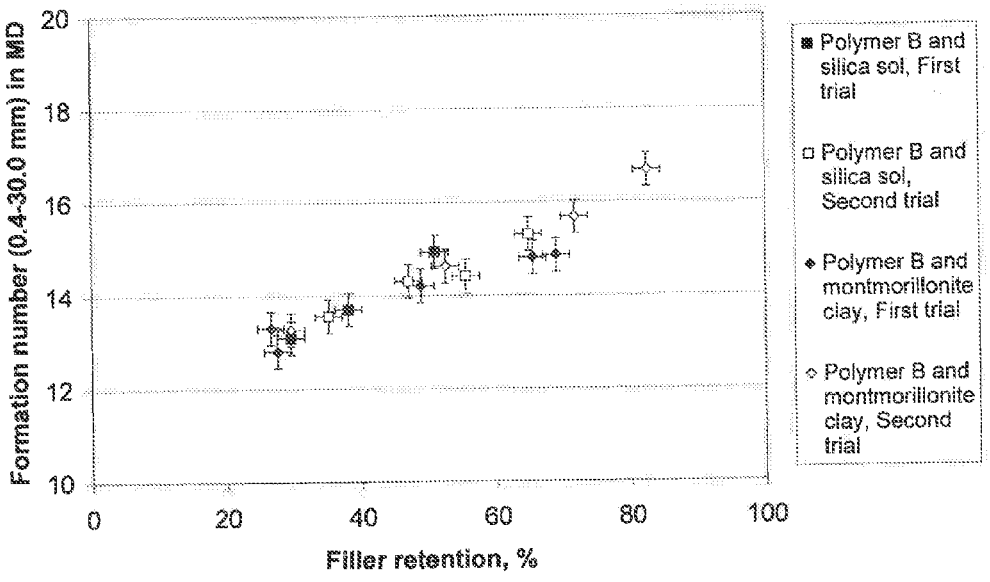

FIG. 2 shows the total formation number (0.4-30 mm) in the machine direction as a function of the GCC filler retention (%), for the two dual component retention aid systems: Polymer B (600-1800 g/ton) and colloidal silica (3 kg/ton); Polymer B (300-900 g/ton) and Na-montmorillonite clay (2 kg/ton). The study was performed on the R-F-machine (see "A Pilot Web Former to Study Retention-Formation Relationships", Svedberg, A. and Lindström, T. Nordic Pulp and Paper Research Journal, 25(2) (2010) 185-194) for a fine paper stock (Hardwood/Softwood ratio 9/1) with addition of 20% filler (GCC) (based on solids content).

FIG. 3 shows a dosage system (arrows above process line) and measuring points (arrows below process line) in the stock flow of the R-F-machine. Dimensions are not scaled.

FIG. 4 shows the total formation number (0.4-30.0 mm) in the machine direction (MD) as a function of the added amount of anionic polymer (g/t). Data are shown for three anionic polymers of varied structure (cross-linked, partly cross-linked and linear), which were investigated in conjunction with C-PAM (cationic polyacrylamide) and anionic sodium montmorillonite clay. The study was performed on the R-F-machine for a fine paper stock (Hardwood/Softwood ratio 9/1) with addition of 25% precipitated calcium carbonate (FCC) as filler (based on solids content). The additions of C-PAM and sodium montmorillonite clay were constant (400 g/t and 2000 g/t, respectively). The residence times were 5.6 s for the C-PAM, 2.3 s for the anionic polymer and 2.0 s for the montmorillonite clay.

Figure 5:
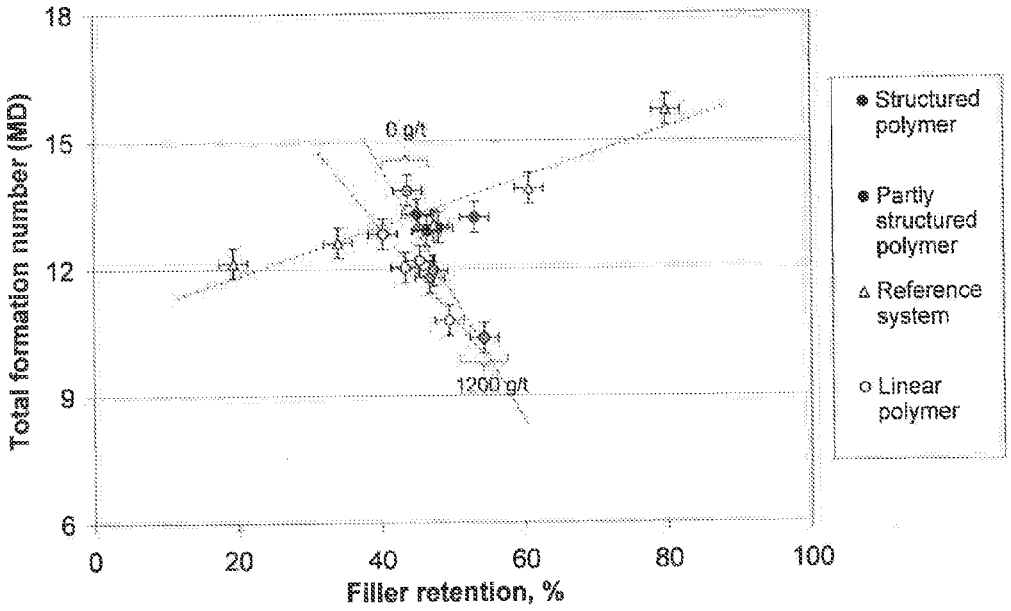

FIG. 5 shows the total formation number (0.4-30.0 mm) in the machine direction (MD) as a function of the filler retention (%). Data are shown for a dual reference system (C-PAM (400 g/tonne) and montmorillonite clay (2 kg/tonne)) and three 3-component systems (reference system plus anionic polymer) of varied anionic polymer. The anionic polymers were varied by structure (cross-linked, partly cross-linked and linear) and the additions were varied between 200 g/t and 1200 g/t. The study was performed on the R-F-machine for a fine paper stock (Hardwood/Softwood ratio 9/1) with addition of 25% filler (PCC) (based on solids content).

Figure 6:
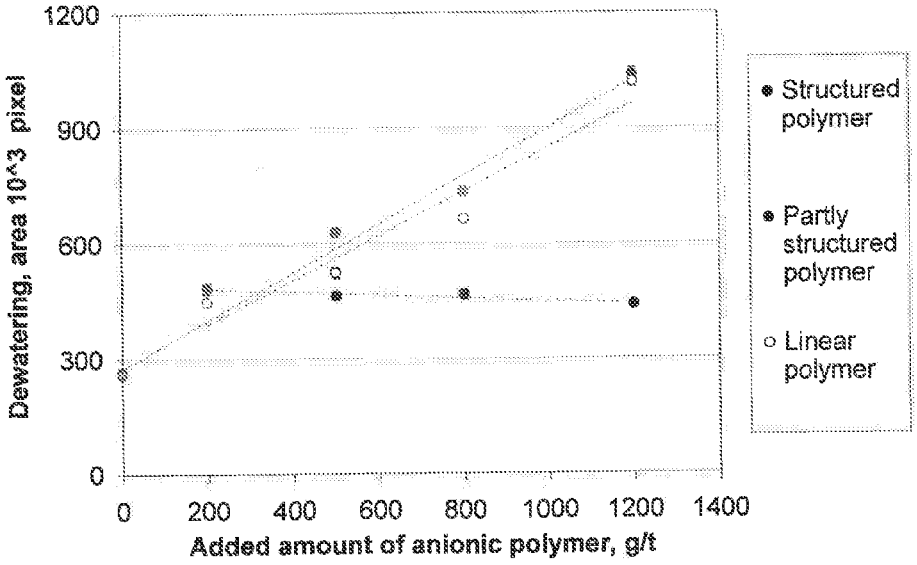

FIG. 6 shows the dewatering in terms of area (see "Improvement of the Retention-Formation Relationship using Three-component retention aid systems", Svedberg, A. and Lindström, T. Nordic Pulp & Paper Research Journal (2012), 27(1), 86-92) $10^3$ (10^3) pixel as a function of the amount of added anionic polymer (g/t). Data are shown for three 3-component systems with varying anionic polymer (C-PAM+anionic polymer+sodium montmorillonite clay). The anionic polymers were varied by structure (cross-linked, partly cross-linked and linear). The study was performed on the R-F-machine for a fine paper stock (Hardwood/Softwood ratio 9/1) with addition of 25% filler (PCC) (based on solids content). The additions of C-PAM and montmorillonite clay were constant (400 g/t and 2000 g/t, respectively).

Figure 7:
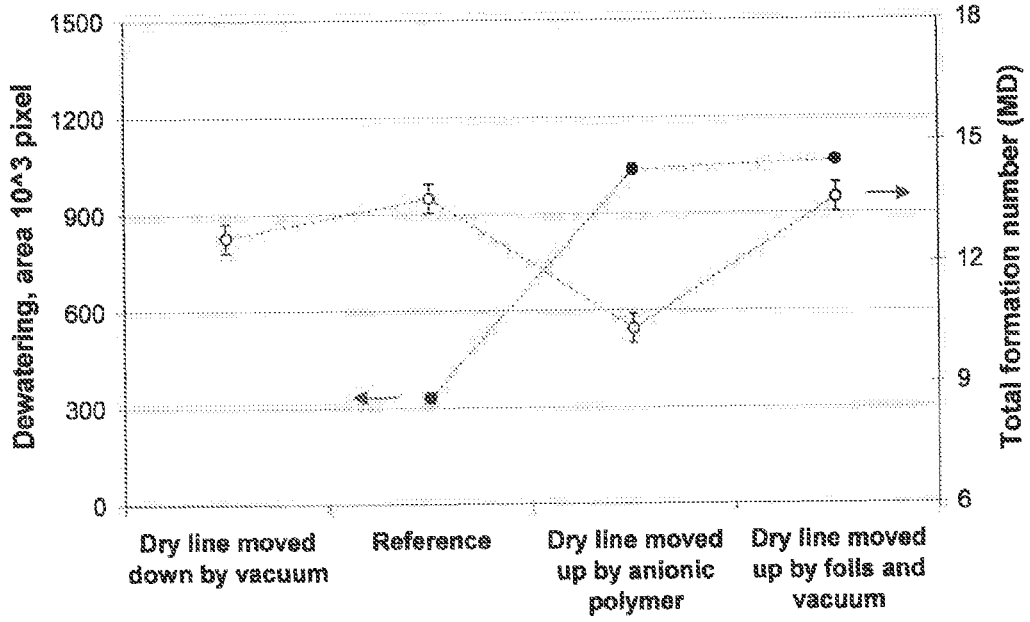

FIG. 7 shows the dewatering in terms of area $10^3$ (10^3) pixel and the total formation (0.4-30.0 mm) in the machine direction (MD) as a function of the dry line position. The dry line was moved from the reference state in three manners; down by increased vacuum, up by over-dosage of anionic polymers; and moved up by reducing the number of foils and vacuum. The study was performed on the R-F-machine for a fine paper stock (Hardwood/Softwood ratio 9/1) with addition of 25% filler (PCC) (based on solids content).

EXAMPLES

Example 1

Tests with Commercial Retention Aid Systems

This example shows that the relationship between retention and formation is unique for 5 widely different commercial retention aid systems. The first three systems were cationic polyacrylamides (C-PAM) with different molecular weights, the fourth system was the two-component system (Compozil), composed of a C-PAM combined with a colloidal silica sol. The fifth system was another two-component system, composed of a C-PAM, and a sodium montmorillonite sol (Hydrocol). All systems are widely used in the paper industry.

The R-F (Retention-Formation) machine used was a pilot-scale fourdrinier former designed to study retention, paper formation and drainage rates on the wire part. The details of the R-F-machine have previously been described in "A Pilot Web Former to Study Retention-Formation Relationships" by Svedberg, A. and Lindström, T. Nordic Pulp and Paper Research Journal, 25(2) (2010) 185-194. A fourdrinier type of paper-machine was used, and run at 260 m/min. Stock consistency was 5 g/l and the sheets had a grammage of 60 g/$m^2$.

The first pass retention with respect to the filler (Rf) in percent, was defined by:

$$Rf = \left(1 - \frac{C_2}{C_1}\right) * 100 \quad [1]$$

where $C_1$ is the concentration of filler in the headbox and $C_2$ is the concentration of filler in the wire pit.

The paper formation was determined by the FUJI-method at MoRe Research, Sweden. The FUJI-method measures local variations in grammage according to a beta radiographic method ("The measurement of mass distribution in paper sheets using a beta radiographic method", Norman, B and Wahren, D. Sv. Papperstid, 77(11), 397 (1974); Beta-radiation based on grammage formation measurement-Radiogram methods applicable to paper and light weight board, Norman, B. (2009), Nordic Standardization Programme Report No. 5).

The results from this method are presented as formation numbers. The formation number is a measure of the local grammage variations in the paper sheet. Hence, a high number represents worse formation and a deterioration of paper properties with respect to strength, printability and aesthetic appeal.

The pulps used were a refined hardwood and softwood bleached kraft pulps. The furnish was a mixture of 90% hardwood (HW) (mainly birch 90-96%) and 10% softwood (SW) (about 45-60% spruce, the rest pine). The filler used was a ground calcium carbonate pulp (GCC). The filler content of the paper was approximately 20%.

The polymers used in the retention trial with the single component systems were three commercial cationic polyacrylamides: Polymer A (Mw=$34\times10^6$ Daltons. Charge density=+0.82 meq/g); Polymer B (Mw=$6\text{-}8\times10^6$ Daltons. Charge density=+1.02 meq/g); Polymer C (Mw=$10\text{-}11\times10^6$ Daltons. Charge density=+1.06 meq/g).

In the two dual component systems. Polymer B was combined with either colloidal silica (Silica NP, Eka Chemicals) or a sodium montmorillonite clay (Hydrocol SH, Ciba Specialty Chemicals).

The total formation number, in the machine direction as a function of the filler retention (%), for three cationic polyacrylamides of varying molecular weights (Polymer A-C) was determined and the results in FIG. 1 show that there appears to be a single relationship between retention and formation for the three C-PAMs, irrespective of their Mw. The formation is deteriorated, with increased filler retention, which is the expected result since an increased flocculation leads to an increased retention and worsened formation.

In a second set of experiments two dual system type of retention aid system were investigated. The first was polymer B combined with a silica sol (Compozil) and polymer B combined with sodium montmorillonite clay (Hydrocol). The results are shown in FIG. 2. Again, the retention/formation relationship follows a single relationship. When the results of FIG. 1 are compared with the results of FIG. 2, it is evident that there is nearly a single relationship for all five systems.

In conclusion, example 1 shows that the retention/formation relationship for many commercial retention aid systems are almost equal.

Example 2

Improvement of the Retention/Formation Relationship by Addition of Anionic Polymers, in Accordance with the Invention In this example, various trials were conducted wherein a third component was added to a dual polymer system and the effects on the retention/formation relationship were investigated.

The same pilot paper machine and the same pulp (Hardwood/Softwood=9/1) as in example 1 was used. Instead of GCC, PCC (Precipitated Calcium Carbonate) was used at a filler level of 20%. The same machine speed and consistency was used as in example 1.

All polymeric retention aids used were supplied by BASF. Characteristics, as per the supplier, are given for all components in table 1. A co-polymer of acrylamide and N,N,N-trimethylamino-ethylacrylate, denominated C-PAM, was used as cationic flocculant (Percol 178). The commercial product names of the remaining components were; linear anionic polymer (Percol 156), partly cross-linked anionic polymer (M 305), cross linked anionic polymer (M 200) and the sodium montmorillonithe clay (Hydrocol SH).

TABLE 1

Characteristics of the retention aids used

| System component | Charge density[1] | Intrinsic viscosity[2] | Standard viscosity[3] |
|---|---|---|---|
| C-PAM | +1.15 meq/g | 11 dl/g | — |
| Linear anionic polymer | −1.76 meq/g | 14 dl/g | — |
| Partly cross-linked anionic | −2.16 meq/g | 10 dl/g | — |
| Cross-linked anionic | −2.50 meq/g | — | 2 mPa · s |
| Montmorillonite clay | −0.34 meq/g | — | 30 mPa · s |

[1]Measurements were made with Mütek ™ Particle Charge Detector (PCD).

[2]A suspended-level viscometer was used to determine the specific viscosity of the test component at various concentrations in a 1M sodium chloride buffer solution. Reduced specific viscosity was plotted against concentration and the intrinsic viscosity was obtained by extrapolation to infinite dilution. The longer the polymer chains, the higher the intrinsic viscosity (dl/g). The test method refers to js ACSMOT No: 7.

[3]The value given for the montmorillonite clay is the direct bulk viscosity of a 5% solution. A Brookfield LVT viscometer was used to characterize the standard viscosity of the anionic polymer (0.1% solution), the method being referred to as L.A. Test Method 20.

The titrating reagents used were (i) polydiallyldimethylammonium chloride (0.001N) for the anionic polymers; and (ii) potassium polyvinylsulfate (0.001N) for the cationic polymer. The approximate molecular weight of these two titrating reagents is $2\times10^5$ Dalton. The montmorillonite clay was analyzed according to the PAP-SOP 01-19 method.

The retention aid components in the three component system were C-PAM, different A-PAMs (linear, partly cross-linked and cross-linked) and finally the sodium montmorillonite. The C-PAM was added first (0.4 kg/tonne), then the anionic polymer was added (0.2-1.2 kg/tonne) and finally the sodium montmorillonite was added (2 kg/tonne). The addition sequence for the latter two additives was not critical.

Papers with a grammage of 60 g/m$^2$ containing approximately 20% filler were produced at a machine speed of 260 m/min, using a jet-to-wire speed ratio of 1:2. The stock consistency was 5 g/l and the volumetric headbox flow rate was 910 l/min. Experimental conditions (dosages and residence times) for the evaluated retention aid systems are summarized in table 2 below. The dosage system in the stock flow of the R-F-machine is illustrated in FIG. 3.

TABLE 2

Experimental conditions in the pilot web former experiments.

| System components | Dosages (kg/t) | Residence time* (s) |
|---|---|---|
| C-PAM | 0.4 | 5.6 |
| Linear anionic polymer | 0.2-1.2 | 2.3 |
| Partly cross-linked | 0.2-1.2 | 2.3 |
| Anionic polymer | 0.2-1.2 | 2.3 |
| Montmorillonite | 2.0 | 2.0 |

*The residence time corresponds to the time from addition to head box.

The retention values and formation values were evaluated as in example 1.

This example shows how an anionic polyacrylamide as an additional additive improves the retention/formation relationship and the drainage characteristics. The three-component systems were based on cationic polyacrylamide (C-PAM), high molecular weight anionic polymer and anionic montmorillonite clay, in the manner described below. The high molecular weight anionic polymer was varied by dosage and structure. Characteristics of the polymers are given in table 1.

All retention aid systems evaluated are shown in table 3.

TABLE 3

Retention aid systems used in this work

| Program | Cationic flocculant | Anionic polymer | Micro particle |
|---|---|---|---|
| 1 | C-PAM | — | Montmorillonite |
| 2 | C-PAM | Linear A-PAM | Montmorillonite |
| 3 | C-PAM | Partly cross linked A-PAM | Montmorillonite |
| 4 | C-PAM | Cross linked A-PAM | Montmorillonite |

Effect of High Molecular Weight Anionic Polymers on Retention and Formation

The objective was to study the effect of high molecular weight anionic polymers on retention and formation. The anionic polymers investigated, were added in conjunction with a dual microparticulate system composed of 0.4 kg/t cationic polyacrylamide (C-PAM) and 2.0 kg/t anionic montmorillonite clay. The effect of increased amounts of anionic polymer and the importance of the anionic polymer structure are shown in FIGS. 4-6.

FIG. 4 shows the total formation number in the machine direction as a function of the added amount of anionic polymer (g/t). The results demonstrate different trends depending on the anionic polymer structure used. The formation was significantly improved when the linear and the partly cross-linked polymer were used and as the added amount increased. The best formation was obtained at the highest investigated polymer dosage (1200 g/t). For the cross-linked polymer, on the other hand, the formation remained the same independent of the polymer dosage.

Irrespective of the added amount and the structure of the anionic polymer, the retention of filler remained at the same level (~50%). This, together with the formation results reported in FIG. 4, gives rise to the relationships in FIG. 5, which show the formation as a function of filler retention (%). In FIG. 5, data are shown both for a dual reference system (C-PAM and montmorillonite clay) and for the three-component systems of varied anionic polymer structure (cross linked, partly cross linked and linear). Basically, the retention-formation relationship remains unchanged irrespective of the additions of C-PAM and montmorillonite in this two-component system.

The results in FIG. 5 demonstrate that the interdependency between retention and formation can be broken, i.e. the formation can be improved without impairing the retention. The improvement was obtained by addition of anionic polymer in surplus, in conjunction with C-PAM and montmorillonite clay. This held for the linear and the partly cross linked anionic polymers, but not for the cross-linked polymer. The dual reference system suggested a linear relationship between retention and formation, where increased retention was accompanied with impaired formation. Along the trend lines, the added amounts of anionic polymer (in the three-component system) respectively cationic polymer (in the two-component system) were increased. As shown in FIG. 5, the higher the added amount of anionic polymer, the better the formation. The interesting feature of the addition of the A-PAM is that both the retention and the formation are improved simultaneously. The cross linked polymer improves the retention slightly but does not improve formation. The important conclusion is that the linear polymer is equally effective as the partially cross-linked polymer.

The trends reported in FIG. 4 and FIG. 5 were repeated in a separate trial. The high degree of reproducibility is revealed in FIG. 4, which compares the first and second trial wherein partly cross-linked polymer was used.

Example 3

Effect of the Addition of Anionic Polymer on Dewatering, in Accordance with the Invention In contrast to the advantageous effects on paper formation, the addition of anionic polymer in surplus resulted in a reduction in drainage rate.

It is well-known (Lee, P. and Lindström, T. (1989) Nord. Pulp Paper Res. J., 4(2), p. 61-70) that the addition of A-PAM will slow dewatering on paper-machines. Therefore, the dewatering was examined in the paper-machine trials disclosed in example 2.

The dewatering was quantified in terms of vertical displacements of the dry line on the wire section. The applied method was based on light scattering and used a charge coupled device (CCD) camera to image the dry line by change in dewatering. The dry line was identified as the border line between the scattering and non-scattering areas, i.e. the area after the dry line and the area before, respectively. A series of image processing steps quantified the change in the dewatering as the area of the adjoining wet surface. The results are given as areas $10^3$ (10^3) pixel with standard errors, where a high number correlates to poor dewatering (see "Improvement of the Retention-Formation Relationship using Three-component retention aid systems" Svedberg, A. and Lindström, T. Nordic Pulp & Paper Research Journal (2012), 27(1), 86-92).

The results are displayed in FIG. 6, where the dewatering in terms of area $10^3$ (10^3) pixel is given as a function of the added amount of anionic polymer (gram/tonne) for the 3 three-component systems.

The results in FIG. 6 are clear. The dewatering number is significantly increased when the added amount of the linear and partly cross-linked anionic polymers are increased. A high dewatering number correlates to poor drainage. No effect was observed on dewatering when the cross-linked polymer was used. From these arguments, it follows that if the advantage of improved formation should be utilized, the system should be used in conjunction with systems that have a good dewatering capability. Microparticulate systems, such as Compozil (Cationic polyacrylamide/cationic starch in combination with silica sols) and Hydrocol (Cationic polyacrylamide/cationic starch starch) in conjunction with sodium montmorillonite have a particular advantage, when it comes to improving the dewatering.

Example 4

Effect of the Addition, of Anionic Polymer on Formation and Dewatering, in Accordance with the Invention Since dewatering was affected by adding high amounts of anionic polymer, it was investigated whether the formation improvements were caused by changed chemistry or by the effect of changed dewatering. (see FIG. 7)

FIG. 7 shows the dewatering in terms of area $10^3$ (10^3) pixel and the total formation in the machine direction (MD) as a function of the dry line position. The dry line was moved from the reference state in three manners; down by increased vacuum, up by over-dosage of anionic polymer, and moved up by reduced number of foils and vacuum.

The trials, results of which are shown in FIG. 7, were designed to vary the dry line position on the wire, both mechanically and chemically, from a reference position. The reference position was obtained for a dual reference system (C-PAM (400 g/t) and montmorillonite clay (2 kg/t)) and with standard machine settings. The dry line position was changed to the same upper register, both mechanically by reducing the number of foils and vacuum, and also chemically by adding anionic polymer in surplus. The anionic polymer was partly cross linked and added at the highest dosage (1200 g/t), in conjunction with C-PAM (400 g/t) and montmorillonite clay (2 kg/t). The dry line was also moved down by increasing the vacuum. This experiment was performed on the R-F-machine for a fine paper stock (Hardwood/Softwood ratio 9/1) with addition of 25% filler (PCC) (based on solids content).

The dewatering in terms of area $10^3$ (10^3) pixel and the total formation in the machine direction are shown as functions of the dry line position, in FIG. 7. The higher the dewatering numbers, the higher the position of the dry line. From FIG. 7, it can be concluded that the formation improvements presented in FIGS. 2 and 4 are caused by a chemical mechanism due to over-dosage of the anionic polymer. The formation was not affected when the dry line position was changed mechanically up and down in relation to the reference position.

Example 5

Damping of Turbulence, in Accordance with the Invention

This example shows how different combinations of fibres, anionic polyacrylamide and NFC dampens the turbulence. This experiment was set up by studying the pressure drop of a pulp suspension when pumping the suspension in a tube and measuring the pressure drop in the presence of cellulose fibres, anionic polyacrylamide A-PAM and NFC. The pressure drop when pumping water is $P_0$ and when pumping the fibre suspension with various added constituents is $P_1$. The drag reduction (DR) is then defined as $=(P_0-P_1)/P_0$.

The higher the drag reduction, the higher the damping of the turbulence.

Table 4 shows the drag reduction (%) in various fluids at two flow rates

| Fluid | Flow rate: 2 m/s | Flow rate: 6 m/s |
|---|---|---|
| Fibre suspension (5/g/l) | 6.8 | 9.4 |
| A-PAM (1.7 mg/l) | 6.9 | 10.2 |
| MFC (0.1 g/l) | 1.6 | 6.4 |
| Fibre (5 g/l) + A-PAM (1.7 mg/l) | 7.1 | 18.4 |
| Fibre (5 g/l) + MFC (0.1 g/l) + A-PAM (1.7 mg/l) | 25 | 20.6 |

As shown in table 4, cellulosic fibres, A-PAM and MFC/NFC all have a drag reduction effect. If both fibres and A-PAM are present there is an additive effect, which is greatly enhanced by the addition of MFC/NFC. The mix of A-PAM and MFC/NFC should be optimized with respect to the stock flow rate.

The invention claimed is:

1. A process for making paper or paper board comprising:

I. forming a cellulosic fibre suspension,

II. flocculating the suspension,

III. draining the suspension on a device to form a sheet and then

IV. drying the sheet, wherein the suspension is flocculated using a formation improving 3-component flocculation system comprising (a) a linear cationic or amphoteric co-polymer of i) acrylamide, and ii) a substance with formula I

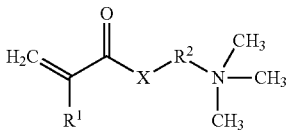

wherein $R^1$ is H or $CH_3$

X is O or NH $R^2$ is $C_1$-$C_4$ alkyl, which is substituted with a cationic methyl group, with a halide as counter-ion;

(b) at least one water soluble component chosen from the group of anionic polyacrylamide, non-ionic polyacrylamide and polyethyleneoxide; and (c) inorganic microparticles, whereby the flocculation system does not contain a water-dispersible or branched anionic organic polymer.

2. The process according to claim 1, wherein the substance with formula I is selected from the group consisting of N,N,N-trimethyl-2-aminoethyl acrylate; N,N,N-trimethyl-2-aminoethyl methacryl amide; and 3-acrylamide-3-methyl-butyl-trimethyl-ammonium chloride.

3. The process according to claim 1, wherein the linear cationic or amphoteric co-polymer has a molecular weight above $10^6$ Daltons.

4. The process according to claim 1, wherein the linear cationic or amphoteric co-polymer has a cationicity ranging from 1 to 100 mole %.

5. The process according to claim 1, wherein the non-ionic polyacrylamide is substantially linear.

6. The process according to claim 1, wherein the anionic and/or non-ionic polyacrylamide is cross linked up to 15%.

7. The process according to claim 1, wherein the anionic and/or nonionic polyacrylamide has a molecular weight above $10^6$ Daltons.

8. The process according to claim 1, wherein the anionic and/or nonionic polyacrylamide have an ionicity from 0 to 100 mole % of anionic groups.

9. The process according to claim 1, wherein inorganic microparticles are selected from the group consisting of siliceous material, siliceous material from montmorillonite clay, siliceous material from colloidal silica, siliceous material from anionic silica and siliceous material from Na montmorillonite.

10. The process according to claim 1, wherein the flocculation system further comprises microfibrillar cellulose and/or nanofibrillar cellulose

11. The process according to claim 1, wherein the linear cationic or amphoteric co-polymer has a molecular weight above $2\times10^6$ Daltons.

12. The process according to claim 1, wherein the linear cationic or amphoteric co-polymer has a molecular weight above $4\times10^6$ Daltons.

13. The process according to claim 1, wherein the linear cationic or amphoteric co-polymer has a cationicity ranging from 1 to 80 mole %.

14. The process according to claim 1, wherein the linear cationic or amphoteric co-polymer has a cationicity ranging from 1 to 60 mole %.

15. The process according to claim 1, wherein the anionic and/or non-ionic polyacrylamide is cross linked up to 10%.

16. The process according to claim 1, wherein the anionic and/or non-ionic polyacrylamide has a molecular weight above $2\times10^6$ Daltons.

17. The process according to claim 1, wherein the anionic and/or non-ionic polyacrylamide has a molecular weight above $4\times10^6$ Daltons.

18. The process according to claim 1, wherein the anionic and/or non-ionic polyacrylamide have an ionicity below 80 mole %.

19. The process according to claim 1, wherein the anionic and/or non-ionic polyacrylamide have an ionicity from 0 to 60% mole %.

20. Paper or paper board comprising:

(a) a linear cationic or amphoteric co-polymer of i) acrylamide; and ii) a substance with formula I

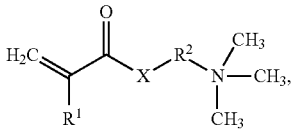

wherein $R^1$ is H or $CH_3$

X is O or NH $R^2$ is $C_1$-$C_4$ alkyl, which is substituted with a cationic methyl group;

with a halide as a counter-ion;

(b) at least one water soluble component selected from the group consisting of anionic polyacrylamide, non-ionic polyacrylamide and polyethyleneoxide; and (c) inorganic micro particles, whereby the paper or paper board does not contain a water-dispersible or branched anionic organic polymer.

21. The paper and paper board according to claim 20, further comprising nano fibrillar cellulose.

* * * * *